US008771108B2

(12) United States Patent
Auzoux

(10) Patent No.: US 8,771,108 B2
(45) Date of Patent: Jul. 8, 2014

(54) TRAINING DEVICE FOR IMPROVING A TENNIS PLAYERS SWING

(71) Applicant: Yann O. Auzoux, Washington, DC (US)

(72) Inventor: Yann O. Auzoux, Washington, DC (US)

( * ) Notice: Subject to any disclaimer, the term of this patent is extended or adjusted under 35 U.S.C. 154(b) by 16 days.

(21) Appl. No.: 13/754,400

(22) Filed: Jan. 30, 2013

(65) Prior Publication Data

US 2013/0296081 A1 Nov. 7, 2013

Related U.S. Application Data

(60) Provisional application No. 61/641,319, filed on May 2, 2012.

(51) Int. Cl.
*A63B 69/38* (2006.01)

(52) U.S. Cl.
USPC ..... 473/463; 473/553

(58) Field of Classification Search
USPC ..... 473/422, 459, 461, 463, 553
See application file for complete search history.

(56) References Cited

U.S. PATENT DOCUMENTS

| | | | | | |
|---|---|---|---|---|---|
| 3,820,785 | A * | 6/1974 | Occhipinti et al. | ..... | 473/463 |
| 3,921,978 | A * | 11/1975 | Warren | ..... | 473/567 |
| 4,079,935 | A * | 3/1978 | Gormley | ..... | 473/530 |
| 4,183,526 | A * | 1/1980 | Brown | ..... | 473/463 |
| 4,189,142 | A * | 2/1980 | de Vries | ..... | 473/542 |
| 5,133,551 | A * | 7/1992 | Handy et al. | ..... | 473/567 |
| 6,669,584 | B1 * | 12/2003 | Miller | ..... | 473/568 |

* cited by examiner

*Primary Examiner* — Nini Legesse
(74) *Attorney, Agent, or Firm* — Buchanan Ingersoll & Rooney PC

(57) ABSTRACT

A training device which includes a face with a first region and a second region, said first region adapted to provide an first auditory output when struck by a tennis ball and said second region adapted to provide a second auditory output when struck by a tennis ball, wherein said first auditory output and said second auditory output are different, a circumferentially grooved region adjacent said face, and a ringlet engageable with said grooved region.

6 Claims, 3 Drawing Sheets

TRAINING DEVICE FOR IMPROVING A TENNIS PLAYERS SWING

BACKGROUND OF THE INVENTION

The present invention relates to training devices for sports, and more specifically, to a tennis racket-like device that provides distinct visual and auditory cues to a player based on ball strike location on the device, so as to assist a player in improving their tennis swing.

Tennis players spend considerable time and energy in perfecting their tennis swing. This endeavor requires dedication, repetition, reinforcement, and strength. There are various ways to support this effort, including coaching, video analysis, strength training and various devices. However, these all have shortcomings. For example, qualified coaching is expensive, video analysis is not practical or time effective on an ongoing basis, strength training is not muscle-specific, and known devices are lacking in their ability to be used repetitively, provide reinforcement, and/or aren't capable of increasing relevant muscle strength.

As can be seen, there is a need for a device that is relatively inexpensive, is practical and time-effective to use, targets the relevant muscles, emulates an actual tennis swing, and provides immediate feedback regarding whether or not the swing was correct. Desirably this device would have the general look and feel of a tennis racket, but be adjustable according to the size, strength and skill of the player. It is also desirable that this device provide distinct and immediate visual and auditory cues to a player, thereby allowing the player to know when they have hit the "sweet spot" of the "racket".

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The major parts of an embodiment include the following structures, as designated in the various FIGS:

10 is the training device;
A is the grip;
B is the elongation member;
C is the neck;
D is the face;
E is the groove;
F is the skull;
G is the hook;
H is the ringlet;
I is the soft ringlet rubber;
J is the heavy ringlet rubber;
K is the ringlet lip;
W is the hitting zone; and
X is the sweet spot.

Figure 1:
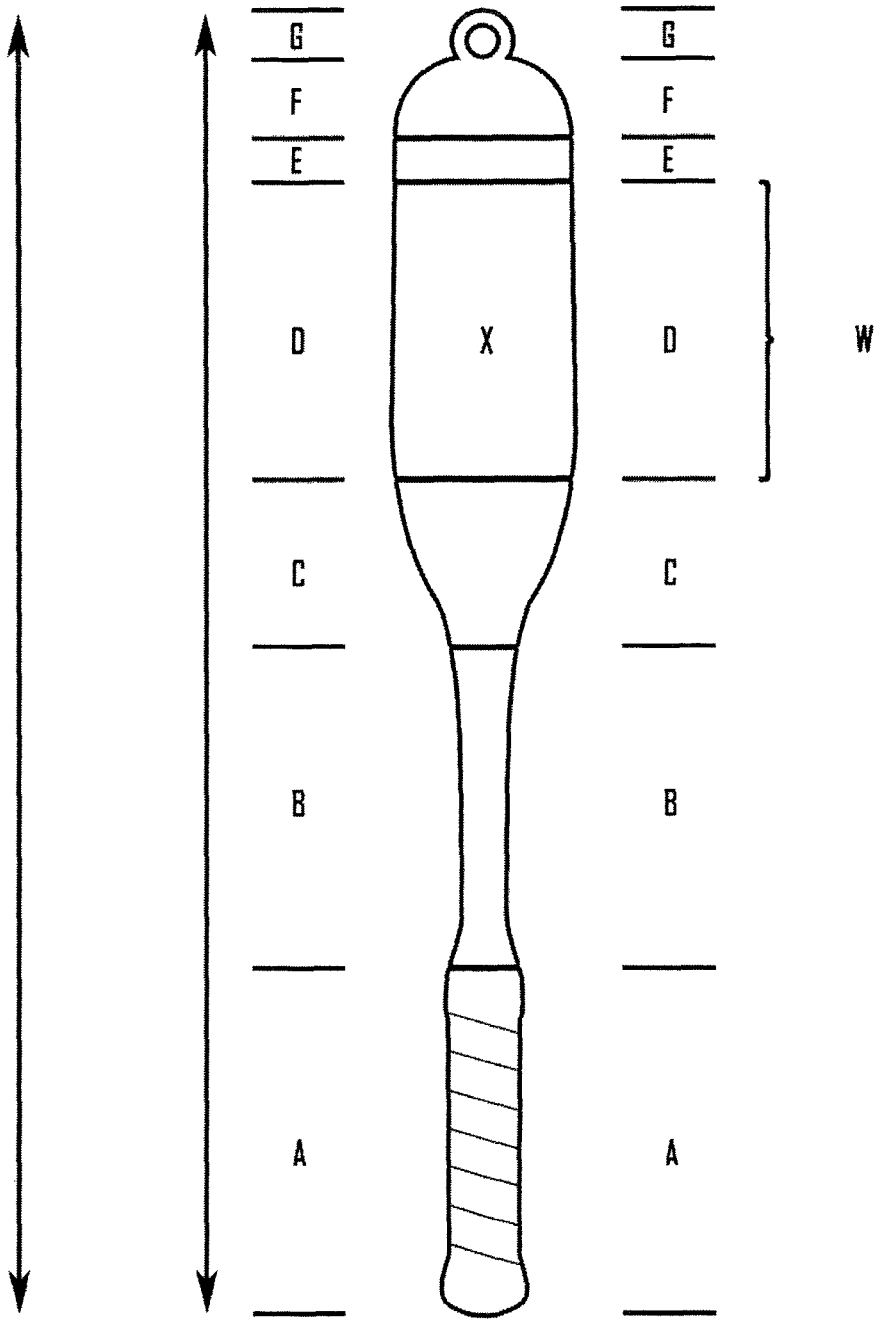
FIG. 1 depicts one embodiment of the invention with a ringlet attached.

Broadly, an embodiment of the present invention provides an adjustable tennis racket-like device that trains a player in proper technique, while providing strength training. Referring to FIG. 1, training device 10 generally includes grip A, which can be a size 4 ⅛ to size 5 ⅝ (corresponding to 0 to 5 in European sizes), depending on the specific player. The grip can be constructed with conventional materials. Elongation member B is desirably tapered, and connects grip A with neck C. It should be slim, strong and aerodynamic, and have a diameter ranging from approximately ½" to approximately 4". Neck C connects elongation member B to face D, and desirably has a thickness of approximately 4" to approximately 8" in diameter.

Face D includes hitting zone W and sweet spot X, and is adapted such that one sound is made when a ball strikes hitting zone W, and another sound is made when a ball strikes sweet spot X. Also, the large "X" marking enables the player, or an observer, to visually identify whether the player hit a ball in the, hitting zone W or with sweet spot X. It is the aim of a player to consistently hit a ball with sweet spot X, as doing so provides greater power and accuracy than other regions of the device, and a racket in actual play. It is desirable that face D have a width of between about 5" and about 8".

Figure 2:
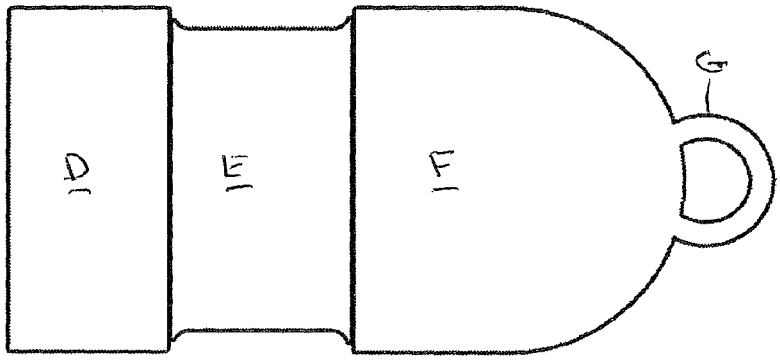
FIG. 2 shows the top portion of one embodiment without a ringlet.
Figure 3:
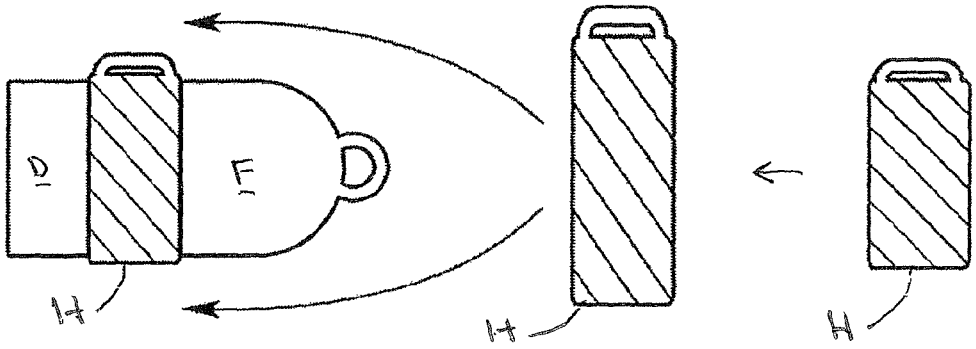
FIG. 3 illustrates a ringlet being situated over a groove.
Figure 5:
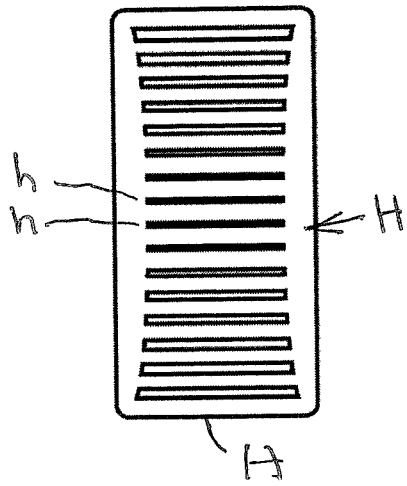
FIG. 5 illustrates the inside surface of a ringlet.
Figure 4:
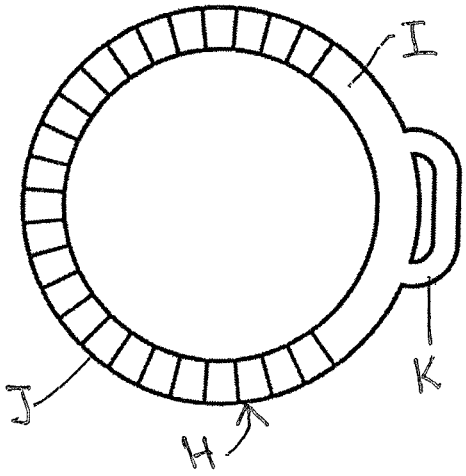
FIG. 4 depicts the details of a ringlet in side view.

As shown in FIG. 2, groove E is between face D and skull F. Groove E is adapted to receive ringlet H. Ringlet H provides additional weight to the device, thereby improving the player's strength and speed, and aiding in swing development. Ringlet H may also provide brand recognition. The construction of ringlet H can be varied to provide different weights, depending on the need of the player. FIG. 3 shows that ringlet H is positioned over groove E by pulling on grip K and stretching ringlet H to expand, then allowing ringlet H to return to original size, thereby "filling" groove E. FIGS. 4 and 5 provide more structural and functional information about ringlet H.

Hook G is at the terminal end of training device 10, and provides an anchor for rubberized strength bands (not shown) and other weighted devices (not shown) for resistance training.

In use, a player uses training device 10 as they would use a tennis racket. That is, they can serve the ball, engage in ball rallies with an opponent, return balls from a tennis serving machine, or the like. However, the player may listen for the auditory cue which indicates that a ball was struck by sweet spot X, or by hitting zone W. The player may optionally be observed by a coach, or video analysis, to further determine the mechanics involved in hitting sweet spot X. This training may be accomplished with or without the addition of ringlet H over groove E, and with or without the addition of resistance bands or the like anchored to hook G.

The training device is similar in look to a short bat but is made of light weight material.

The grip can be cylindrical or multi-sided as in an ordinary grip on a tennis racquet which has two parallel wide sides and two parallel smaller sides connected by beveled edges.

The handle and hitting zone are connected by a small diameter shaft and the training device is shaped like a baseball bat but with a much larger diameter to provide a consistent point and angle of contact when hitting a tennis ball.

The audible sound produced on contact with a tennis ball can be achieved in several ways. For instance, a different sound on impact can be provided by changing the materials of construction in the contact zone, i.e., blend of fibers or materials in the contact zone. Alternatively, the interior of the Sweet Spotter can be filled with material such as foam in areas outside the contact zone so that ball contact in the contact zone produces a higher pitch sound such as a "ping" upon hitting the contact zone (sweet spot) versus a duller sound outside the contact area.

The grip of the training device has a standard tennis grip length of about 8 inches and a grip size of 4 ⅛ to 5 ⅝. The elongation member has a diameter of about 0.5 to 4 inches and a length sufficient to provide an end-to-end overall length of about 21 to 26 inches for young players or about 27 to 29 inches for adult players. The neck can be round or angular with a maximum width or diameter of about 4 to 8 inches. The face (hitting zone) is preferably round with a diameter of about 5 to 8 inches. The groove depth can vary depending on whether the training device is intended for use by young players or adults. For example, to accommodate heavier weights incorporated in the ringlet, the groove can have a greater depth.

The grip, elongation member, neck and face can be made from a laminate of fiber materials such as carbon, fiberglass, graphite, boron, Kevlar or the like. Ceramic fibers can be incorporated in layers of fibrous sheets which are adhesively bonded together to form the training device. Alternatively, the training device could be made from extruded aluminum or other metal such as titanium or the like. Preferably, the training device is made from a laminate of 100% carbon fibers. The interior of the training device can be hollow or filled with lightweight material such as polyurethane foam in areas outside the hitting zone to create a different sound when a tennis ball strikes the hitting zone. For example, a tennis ball striking the training device outside the hitting zone may make a duller sound and when the hitting zone is struck may make a higher pitch sound such as a ping or other discernible noise.

The training device preferably has a low weight of about 8 to 13 ounces which is similar to the weight of junior and adult tennis racquets. To increase the weight, a ringlets of desired weight can be placed in the groove. The ringlet can be selected from a set of ringlets having different weights such as ringlets each having a weight in the range of 1 to 17 ounces. For example, a set of ringlets could include a plurality of ringlets each having a weight of 1 oz, 2 oz, 3 oz, 4 oz, 5 oz, 6 oz, 7 oz, 8 oz, 9 oz, 10 oz, 11 oz, 12 oz, 13 oz, 14 oz, 15 oz, 16 oz or 17 oz. By adding a ringlet of desired weight, the overall weight of the training device can be increased from the base weight of 8 to 13 oz to up to 25 oz. The ringlets can be made of rubber or polymer material with embedded metal bits to vary the weight yet maintain the same shape of the ringlet. However, the ringlets may be made of the same material but with different thicknesses to increase weight of each ringlet. The inner surface of the ringlets can include parallel grooves h to allow easier stretching of the ringlets when installed in the groove.

The face can be the exposed surface of the material used to construct the training device or a cover can be placed over the hitting zone. For example, felts made of leather, rubber, cloth or other material may be bonded to the hitting zone to add spin and/or sound effects to the tennis ball when struck. The cover can be contoured and/or include indicia such as color graphics to identify model, make or provide other information or ornamentation.

What is claimed is:

1. A training device including:

a. a face with a first region and a second region, said first region adapted to provide a first auditory output when struck by a tennis ball and said second region adapted to provide a second auditory output when struck by a tennis ball; wherein said first auditory output and said second auditory output are different;

b. a circumferentially grooved region adjacent said face; and c. a ringlet engageable with said grooved region.

2. The training device of claim 1, wherein the face has a width of about 5 to 8 inches and is located between the grooved region and a tennis grip.

3. The training device of claim 2, wherein the face and grip are connected by a tapered elongation member having a diameter of about 0.5 to 4 inches.

4. The training device of claim 1, wherein the ringlet is removable from the grooved region by stretching the ringlet.

5. The training device of claim 4, wherein the ringlet includes a ringlet lip which can be manually engaged to stretch the ringlet.

6. The training device of claim 1, wherein the training device includes a hook at an end thereof, the hook adapted to serve as an anchor for rubberized strength bands.

* * * * *